US006447873B1

(12) United States Patent
Kornett

(10) Patent No.: US 6,447,873 B1
(45) Date of Patent: Sep. 10, 2002

(54) LEADER DEVICE FOR INSTALLATION OF ON MACHINE SEAMABLE PAPERMAKER'S FABRICS AND BELTS

(75) Inventor: Glenn Kornett, Bonneau Beach, SC (US)

(73) Assignee: Albany International Corp., Albany, NY (US)

( * ) Notice: Subject to any disclaimer, the term of this patent is extended or adjusted under 35 U.S.C. 154(b) by 0 days.

(21) Appl. No.: 09/387,292

(22) Filed: Aug. 31, 1999

Related U.S. Application Data

(60) Provisional application No. 60/140,206, filed on Jun. 22, 1999.

(51) Int. Cl.[7] ..... D21F 7/00

(52) U.S. Cl. ..... 428/99; 139/383 A; 139/383 AA; 162/193; 162/200; 162/273; 162/274; 162/900; 162/902; 428/105; 428/107; 428/109; 428/112; 428/192; 442/205; 442/206; 442/246

(58) Field of Search ..... 428/99, 105, 107, 428/109, 112, 192; 162/193, 200, 273, 274, 900, 902, 904; 139/383 AA, 383 A; 442/205, 206, 246

(56) References Cited

U.S. PATENT DOCUMENTS

| | | | | |
|---|---|---|---|---|
| 3,085,346 | A | 4/1963 | Allander et al. | 162/200 |
| 4,267,018 | A | 5/1981 | Haltsonen et al. | 162/200 |
| 4,735,689 | A | 4/1988 | Kotitschke et al. | 162/273 |
| 4,758,309 | A | 7/1988 | Johansson | 162/273 |
| 5,306,393 | A | 4/1994 | Rhyne | 162/200 |
| 5,429,719 | A | 7/1995 | Rhyne | 162/200 |

*Primary Examiner*—Nasser Ahmad
(74) *Attorney, Agent, or Firm*—Frommer Lawrence & Haug LLP; Ronald R. Santucci

(57) ABSTRACT

A leader used to pull a seamable papermaker's fabric onto a paper machine comprising at least one section of material comprising yarns which are so oriented so as to distribute the load evenly across and down the fabric.

21 Claims, 4 Drawing Sheets

LEADER DEVICE FOR INSTALLATION OF ON MACHINE SEAMABLE PAPERMAKER'S FABRICS AND BELTS

This application claims the benefit of U.S provisional application No. 60/140,206, filed Jun. 22, 1999.

FIELD OF THE INVENTION

The present invention is directed towards a leader used to pull a seamable papermaker's fabric onto a paper machine.

BACKGROUND OF THE INVENTION

Fabrics in modern papermaking machines may have a width of from 5 to over 33 feet, a length of from 40 to over 400 feet and weigh from approximately 100 to over 3,000 pounds. These fabrics wear out and require replacement. Replacement of fabrics often involves taking the machine out of service, removing the worn fabric, setting up to install a fabric and installing the new fabric. While many fabrics are endless, about half of those used in press sections of the paper machines today are on machine seamable. All dryer fabrics used all have a seam of some type. Some Paper Industry Process Belts (PIPBs) are contemplated to have an on machine seam capability, such as some transfer belts, known as Transbelt®. Installation of the fabric includes pulling the fabric body onto a machine and joining the fabric ends to form an endless belt.

An important aspect of loading a fabric body onto a paper machine is that there be uniform tension across the fabric. If uniform tension is not achieved and one section of the fabric pulls more than another, then the fabric can bubble or ridge across the fabric width.

Another aspect of loading a fabric body is preventing damage to the fabric body seam. In order to avoid or minimize the chance of damage to the seam during installation, tension, weight and pressure must be avoided on the seam itself.

A further aspect of loading a dryer fabric, especially very long ones is properly aligning the fabric body in the machine so the dryer fabric guides true in the machine direction (MD) and does not oscillate or track to one side of the machine. If the fabric guides or tracks poorly it can make contact with the paper machine support frame and cause fabric damage.

For fabrics and belts with seams that can be joined together on the paper machine, various types of leaders have been tried to assist installation. In order to avoid or minimize the potential for damaging the fabric body and the machine during installation and operation, the leader should be designed so there is uniform tension across the fabric body. There have been several attempts to design such leaders.

U.S. Pat. Nos. 5,306,393 and 5,429,719 both to Rhyne describe a device and method for installing a fabric body onto a paper machine. The method includes providing a self-aligning fabric loading harness having a leading edge and a plurality of spaced empty grommets disposed adjacent to the leading edge, to which multiple ropes are attached, securing a pull rope through the loading harness and a line receiving device, pulling the pull rope, and automatically readjusting the pull rope through the loading harness to attempt to achieve uniform tension across the fabric.

Some leaders are square or rectangular, with the long dimension to either the MD or CD. Multiple ropes or straps are attached to the leader at evenly spaced apart locations across the width of the leader, and the leader with the attached papermaker's fabric or belt is pulled through the fabric run, and the ends of the papermaker's fabric or belt are brought together and joined by a seam to make the fabric endless. The leader is removed and the fabric is ready for use. However the multiple ropes or straps can get hung up on the stationary equipment in the fabric run, causing difficult and time consuming installation, if not tearing and damage of the fabric.

There are also leaders currently used in the industry which are shaped like an isosceles triangle, having the apex removed to form a trapezoid. The leaders are fabricated from a woven material. The base of a leader has a zipper, which is used to attach the leader to an end of the fabric being installed on the paper machine. Such a design is preferred because only one rope is attached near the apex to pull the fabric onto the machine. When the triangle is cut from woven material, one of the yarn systems in the weave goes straight from the base to the apex and the other is at a 90° angle thereto.

FIG. 1 shows a top view of a prior art leader 10. Leader 10 is shaped like an isosceles triangle and is fabricated from a woven material. The base 12 of leader 10 has a one half a zipper edge 12, which is used to attach leader 10 to an end of the fabric being installed on the paper machine to which the other half of the zipper edge is attached to the fabric or belt. Paper mill personnel can attach a rope near the apex which is provided with a hole 14 and pull the fabric onto the machine. When the triangle is cut from woven material, one of the yarn systems in the weave goes straight from the base to the apex and the other is at a 90° angle thereto. When the rope is pulled as shown in FIG. 1*a*, the force is unevenly distributed across the leader as well as the attached fabric body which causes the fabric body to bunch up on the sides.

Full width steel bars may be inserted at the base of the leader for better weight/tension distribution. However, the bars are heavy, thick and sometimes difficult to pass through the nip formed by two press rolls, or a shoe and opposing roll.

With a leader of this type, even with a 4 foot wide steel reinforcing bar, when the rope is pulled the force is unevenly distributed about the leader and across the attached fabric body. When the apex above is pulled, most of the force is distributed over 4 feet at the center of the leader. This causes the center of the fabric to bunch up, making it more difficult to seam, and often causes the edges of the press or dryer fabric or belt 16 and leader 10 to droop 18 and 20 while it is being pulled onto the paper machine.

The drawback of this type of leader is that the load is always concentrated down its center. This causes the both the center of the leader and the fabric attached to it, to lead the edges and form waves in the center while pulling through the machine, making it more difficult to seam as well as guide through the fabric through the run during installation. This often causes the edges of the fabric to droop while it is being pulled through the fabric run. Any fabric edge droop or bunching/waviness (any departure from a relatively flat fabric profile) can cause the fabric to become hung up on stationary equipment, or to not easily pass through the gap formed between two press rolls. Attempts to correct both the fabric and leader edges from drooping by inserting ropes down the edges, usually results in the edges curling up and folding over, which is also not desirable.

While the types of methods and devices for installing an on machine seamable fabric or belt aforementioned have particular advantages, they also have attendant disadvantages discussed above.

SUMMARY OF THE INVENTION

It is therefore a principal object of the invention to overcome the shortcomings of the devices heretofore mentioned.

It is a further object of the invention to provide a device and method for installing a fabric in a paper machine which evenly distributes the load on the fabric making for easier installation and seaming.

To solve this problem, a leader has been fashioned from three pieces of rectangular material to form a triangle. The pieces are sewn together with a zipper at the base, sewn together near the apex, and a grommet is put through all of the layers near the apex. The leader is attached to the fabric by a zipper, one half of which zipper edge is attached to the leader. Another half of the zipper is attached to the fabric. In the aforementioned version, the three separate fabric layers are tacked or sewn together at the necessary intervals, to prevent excessive drooping of any parts. The layers may be fastened by continuous of intermittent sewing, ultrasonic welding, metallic/plastic staples, rivets, chemical bonding or any other convenient means. Depending on the fabric weight, load distribution achieved, and strength of the leader material itself, more than one grommet can be installed at the apex to prevent "grommet pull out". In such cases, a prefabricated strap bridle is inserted through all the grommets during leader fabrication and again one pull rope is inserted by the end user, through this existing loop.

DETAILED DESCRIPTION OF THE INVENTION

Figure 1:
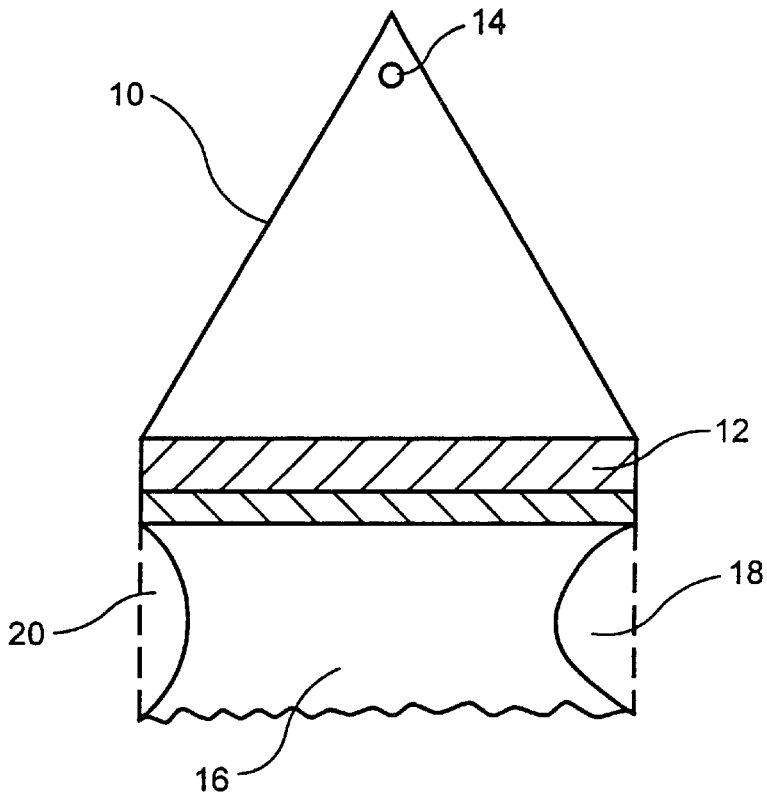
F I G. 1 PRIOR ART
FIG. 1 shows a top view a prior art leader.
Figure 1A:
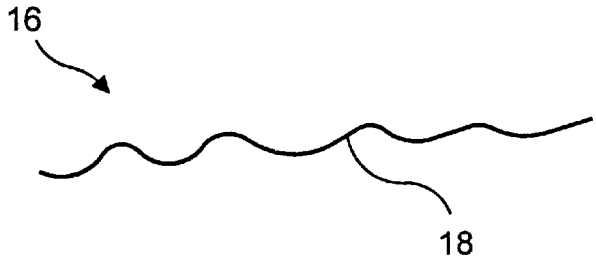
F I G. 1a PRIOR ART
FIG. 1*a* shows a side view of fabric attached to the leader of FIG. 1 after it has been pulled.
Figure 2:
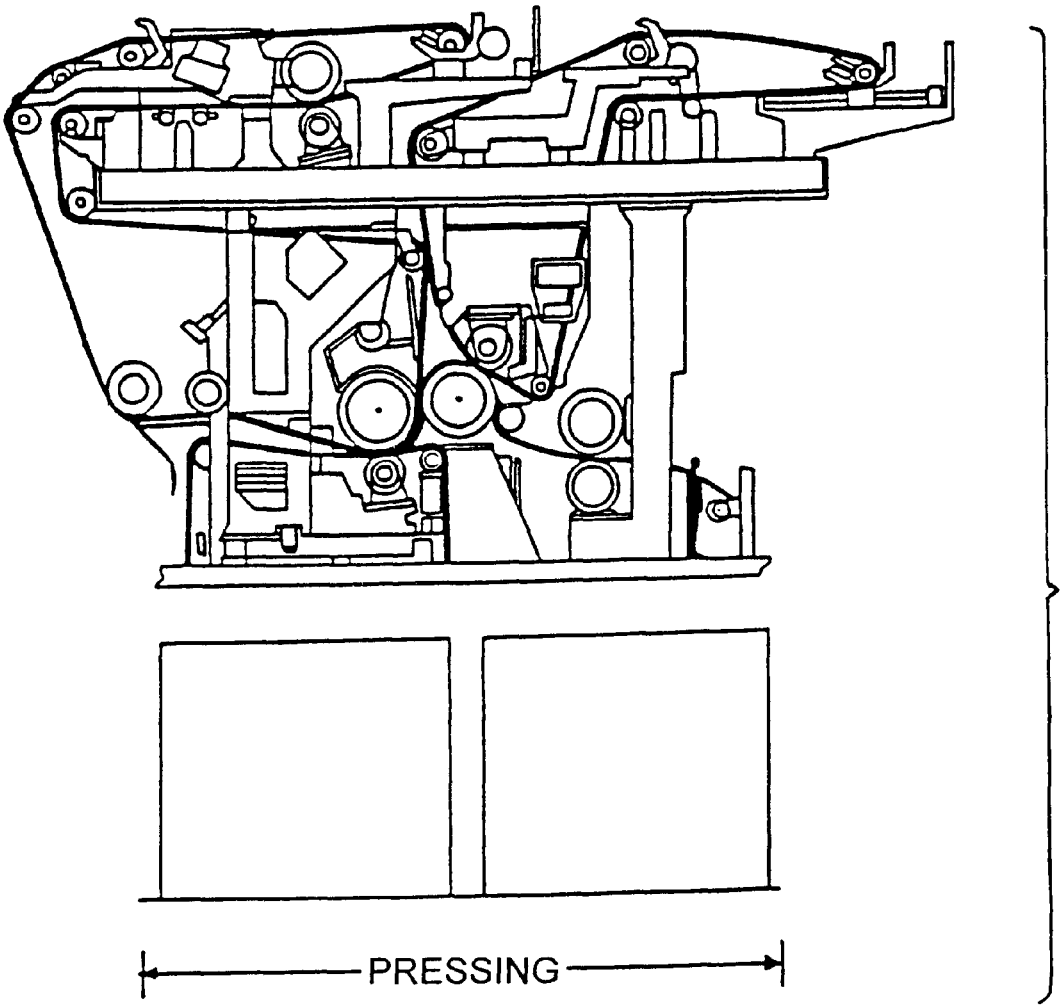
FIG. 2 shows a side view illustrating a pressing roller assembly used in papermaking.
Figure 3:
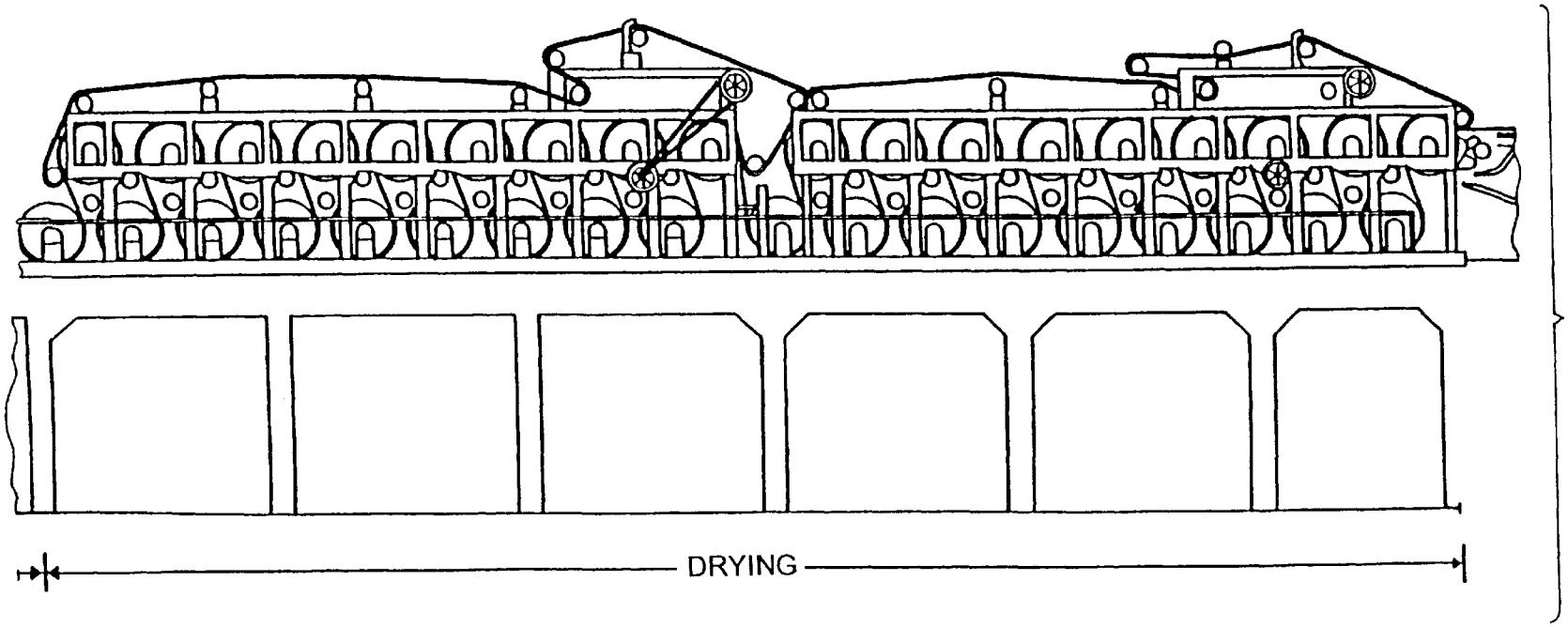
FIG. 3 shows a side view illustrating a drying roller assembly used in papermaking.

Initially, FIG. 2 shows a side view of the press section of a papermaking machine. FIG. 3 shows a side view of the drying section of a typical papermaking machine. The path of the fabric used in these sections is illustrated therein.

Figure 4:
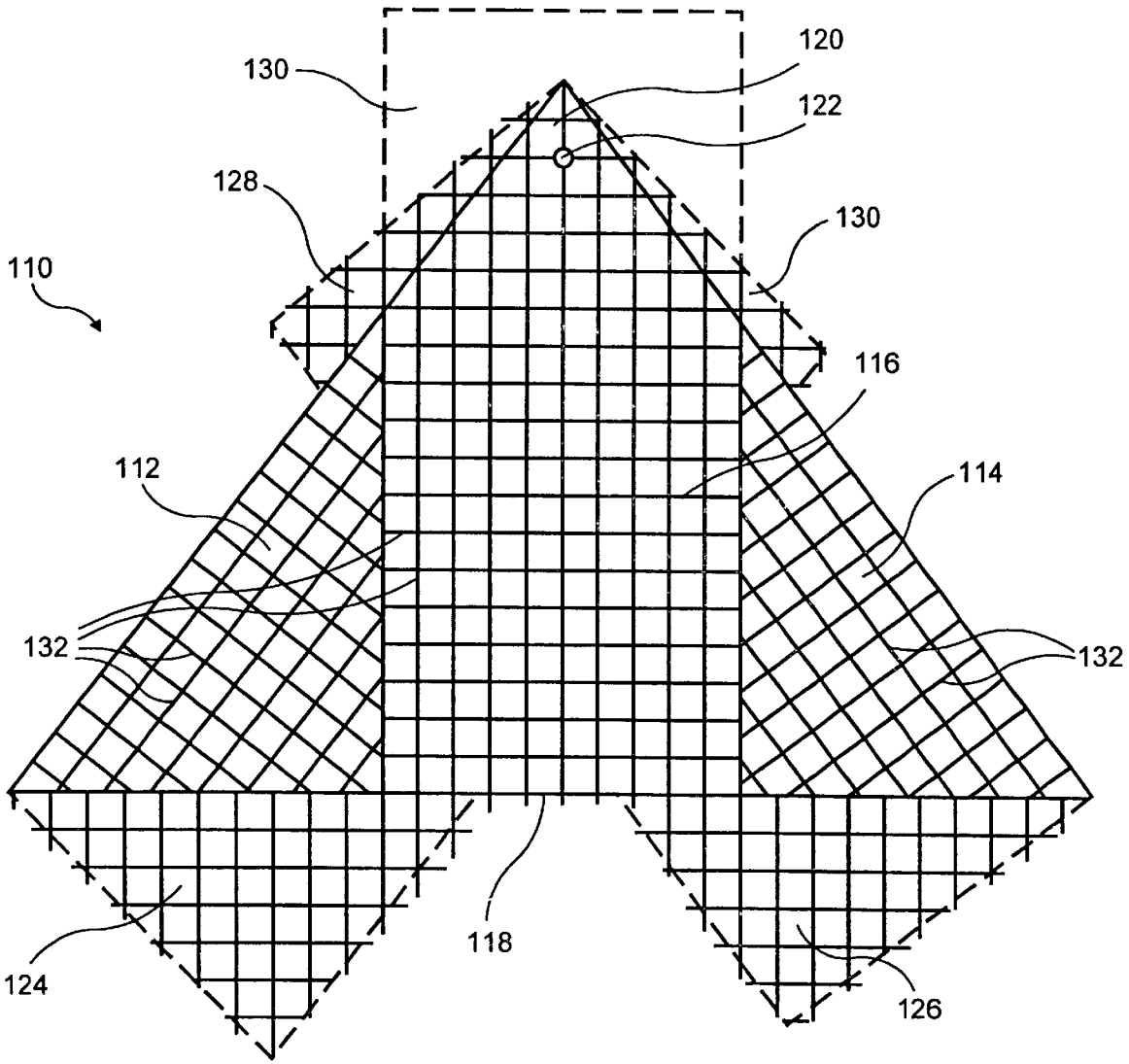
FIG. 4 shows top view of a preferred embodiment of the present invention.

FIG. 4 shows an embodiment of the present inventive leader 110. Leader 110 is fashioned from three pieces of rectangular material to form a triangle. The first piece 112 forms one side of the triangle; the second piece 114 forms the opposing side of the triangle; and the third piece 116 runs down the center of the triangle being formed. The pieces are sewn together with a zipper 118 at the base, and sewn together near the apex 120. A grommet 122 is put through all of the layers near the apex. Excess material 124, 126, 128, and 130 protruding past the edges of the triangle being formed are trimmed so that the leader as a whole takes the shape of a triangle.

The leader 110 is attached to the fabric by a zipper 118, one half of which zipper edge is attached to the leader. Another half of the zipper 118 is attached to the fabric. When the fabric is to be installed on a paper machine, a rope or cable is passed through the grommet 122 and pulled to draw the fabric through and around the components of the machine. The load applied to the leader 110 is distributed down its edges, because yarns in the pieces forming the sides of the leader 110 are at the same angle as the edges. The load is also distributed down the center piece 116. The edges do not droop and the load distribution is very uniform. After the fabric is pulled around the fabric run, the two fabric edges are brought together and the seam is connected. The inventive leader provides superior load/tension distribution. The leader design is not limited to three separate pieces as in the above example as hereafter discussed.

To achieve near perfect load distribution on a 300" wide fabric, would require 300 separate 1" wide pieces of two plane 90 degree woven fabric. They would all be fastened at the base as well as the apex. In such a case "tacking" the individual layers together as mentioned above would not be necessary as the load/tension distribution would be almost perfect. The cost of this degree of perfect load distribution would be prohibitive. Depending on the fabric width, it may be deemed necessary to use more than three separate 90 degree woven fabric pieces to provide the required uniformity of load/tension distribution. Multiple pieces are also not a necessity to achieve the required load distribution which is provided by having as many as possible of the load bearing members in the fabric span the complete distance between the base and apex of the leader. On certain width fabrics, this can also be achieved by "folding a rectangular fabric piece over on itself, at both edges, to form an isosceles triangle". The MD load bearing yarns in the resultant piece would now span the full length from the base to the apex on both edges, providing one chooses the correct height of the triangle based on its base width.

Also, certain fabric types such as some reinforced spun bonded fabrics have superior load distribution characteristics. Employing such fabrics may allow fewer number of "sections" to be used, and if foreseeable that only one piece could be employed, at least on relatively narrow fabrics. At the present A time, no economically priced fabric of this type exists.

When the fabric is to be installed on a paper machine, a rope (not shown) is passed through the grommet 120 and pulled to draw the fabric through and around the components of the machine. The load applied to the leader is distributed down its edges, because yarns in the pieces forming the sides of the leader are at the same angle as the edges. The orientation of the fabric is shown by lines 132. The load is also distributed down the center piece. The edges do not droop and the load distribution is very uniform.

The inventive leader design allows the use of relatively inexpensive lightweight material, because it distributes the load in a more even manner allowing easier seaming since the fabric is flat. The improved leader also pulls the fabric onto the machine more uniformly due to the improved load distribution which keeps the fabric flat and prevents contact with stationary elements such as suction boxes or showers. The leader, since it is relatively thin, and does not require thicker steel reinforcing bars, readily passes through a press nip formed by two press rolls.

Furthermore, the design does not require the use of multiple ropes across the width which is commercially undesirable. Nor does the design require multiple straps or steel bars which have known disadvantages.

The design provides numerous cost advantages by allowing the length of leader to be reduced. In addition, woven material cost may be reduced by using smaller yarns, or fewer larger yarns since the load is taken up by the full leader. Non-woven materials, including reinforced and non-reinforced spunbonds might also be used. Knitted material can also be used. The cost may also be reduced by reducing overall leader length (height of triangle) for some leaders, either for heavy fabrics or very wide fabrics. Triaxial woven material can also be used.

Thus by the present invention its advantages will be realized and preferred embodiments have been disclosed and described herein.

What is claimed is:

1. A fabric loading leader substantially in the shape of a triangle having two sides and a base, and an apex for installing a papermaker's fabric having a leading edge, said leader comprising:

a) a first section of material comprising yarns forming one side of the triangle, wherein the orientation of the yarns of the first section includes yarns that are substantially parallel to the side of the triangle;

b) a second section of material comprising yarns forming the opposing side of the triangle wherein the orientation of the yarns of the second section is substantially parallel to the opposite side of the triangle;

c) a third section of material comprising yarns forming the base of the triangle and the apex of the triangle, wherein the orientation of the yarns of the third section is substantially perpendicular to the base of the triangle;

d) a first attachment means along the base for coupling the base with the leading edge of the papermaker's fabric; and e) a second attachment means near the apex for attaching a rope or cable thereto.

2. A fabric loading leader according to claim 1 wherein the first attachment means is a zipper.

3. A fabric loading leader according to claim 1 wherein the second attachment means comprises at least one grommet.

4. A fabric loading leader according to claim 1 wherein the triangle is an isosceles triangle.

5. A fabric loading leader according to claim 1 wherein the first, second and third sections are attached to the first attachment means.

6. A fabric loading leader according to claim 1 wherein the first, second and third sections are attached to each other by one or more of the following methods from the group consisting of continuous sewing, intermittent sewing, ultrasonic welding, metallic staples, plastic staples, rivets, and chemical bonding.

7. A fabric loading leader according to claim 5 wherein the first, second and third sections are coupled to the first attachment means by one or more of the following methods from the group consisting of continuous sewing, intermittent sewing, ultrasonic welding, metallic staples, plastic staples, rivets, and chemical bonding.

8. A fabric loading leader according to claim 1 wherein the first, second and third sections are rectangular.

9. A fabric loading leader according to claim 1 wherein the first, second and third sections comprise multiple pieces which are joined at the base.

10. A fabric loading leader according to claim 1 wherein the first, second and third sections comprise a material selected from the group consisting of woven materials, non-woven materials, reinforced and non-reinforced spunbonds, triaxial woven material, and knitted material.

11. A fabric loading leader substantially in the shape of a trapezoid having two sides and a base, and a top for installing a papermaker's fabric having a leading edge, said leader comprising:

a) a first section of material comprising yams forming one side of the trapezoid, wherein the orientation of the yarns of the first section includes yarns that are substantially parallel to the side of the trapezoid;

b) a second of material comprising yarns forming the opposing side of the trapezoid wherein the orientation of the yams of the second section is substantially parallel to the opposite side of the trapezoid;

c) a third section of material comprising yams forming the base of the trapezoid and the top of the trapezoid, wherein the orientation of the yams of the third section is substantially perpendicular to the base of the trapezoid;

d) a first attachments means along the base for coupling the base with the leading edge of the papermaker's fabric; and e) a second attachment means near the top for attaching a rope or cable thereto.

12. A fabric loading leader according to claim 11 wherein the first attachment means is a zipper.

13. A fabric loading leader according to claim 11 wherein the second attachment means comprises at least one grommet.

14. A fabric loading leader according to claim 11 wherein the first, second and third sections are attached to the first attachment means.

15. A fabric loading leader according to claim 11 wherein the first, second and third sections are attached to each other by one or more of the following methods from the group consisting of continuous sewing, intermittent sewing, ultrasonic welding, metallic staples, plastic staples, rivets, and chemical bonding.

16. A fabric loading leader according to claim 14 wherein the first, second and third sections are coupled to the first attachment means by one or more of the following methods from the group consisting of continuous sewing, intermittent sewing, ultrasonic welding, metallic staples, plastic staples, rivets, and chemical bonding.

17. A fabric loading leader according to claim 11 wherein the first, second and third sections are rectangular.

18. A fabric loading leader according to claim 11 wherein the first, second and third sections comprise multiple pieces which are joined at the base.

19. A fabric loading leader according to claim 11 wherein the first, second and third sections comprise a material selected from the group consisting of woven materials, non-woven materials, reinforced and non-reinforced spunbonds, triaxial woven material, and knitted material.

20. A fabric loading leader for installing a papermaker's fabric having a leading edge, said leader comprising at least one section of material comprising yarns which are so oriented so as to distribute the load evenly across and down the fabric, wherein the material comprises a triaxial woven material.

21. A fabric loading leader for installing a papermaker's fabric having a leading edge, said leader comprising at least one section of material comprising yarns which are so oriented so as to distribute the load evenly across and down the fabric, wherein the leader comprises reinforced spun bonded material.

* * * * *